US007238877B1

(12) United States Patent
Hosler et al.

(10) Patent No.: US 7,238,877 B1
(45) Date of Patent: Jul. 3, 2007

(54) MUSICAL INSTRUMENT STRING GROUND CIRCUIT BREAKER

(75) Inventors: David A. Hosler, El Cajon, CA (US); Trenton Blizzard, La Mesa, CA (US)

(73) Assignee: Taylor-Listug, Inc., El Cajon, CA (US)

( * ) Notice: Subject to any disclaimer, the term of this patent is extended or adjusted under 35 U.S.C. 154(b) by 0 days.

(21) Appl. No.: 11/360,114

(22) Filed: Feb. 22, 2006

(51) Int. Cl.
*G10H 1/32* (2006.01)

(52) U.S. Cl. ..... 84/743

(58) Field of Classification Search ..... 84/743
See application file for complete search history.

(56) References Cited

U.S. PATENT DOCUMENTS

| | | | | |
|---|---|---|---|---|
| 3,454,702 A | | 7/1969 | Elbrecht | |
| 3,668,469 A | * | 6/1972 | Lee | 361/46 |
| 3,860,876 A | | 1/1975 | Woods | |
| 4,285,262 A | * | 8/1981 | Scholz | 84/313 |
| 4,468,997 A | * | 9/1984 | Young, Jr. | 84/722 |
| 4,765,219 A | * | 8/1988 | Alm | 84/726 |
| 5,168,438 A | | 12/1992 | Smith | |
| 6,559,369 B1 | | 5/2003 | Gilmore | |
| 2003/0140770 A1 | | 7/2003 | Barry | |
| 2004/0100324 A1 | | 5/2004 | Fryette | |
| 2004/0264712 A1 | | 12/2004 | Lace | |
| 2005/0123144 A1 | | 6/2005 | Wallace | |

FOREIGN PATENT DOCUMENTS

DE 4019378 A * 1/1991

* cited by examiner

*Primary Examiner*—Lincoln Donovan
*Assistant Examiner*—Andrew R Millikin
(74) *Attorney, Agent, or Firm*—Peter K. Hahn; Luce, Forward, Hamilton & Scripps, LLP

(57) ABSTRACT

The present invention is directed to a stringed, musical instrument where the instrument strings are grounded by a string ground circuit, and wherein the string ground circuit includes a circuit breaker having a current path that defines a portion of the string ground circuit between the strings and a ground.

24 Claims, 5 Drawing Sheets

MUSICAL INSTRUMENT STRING GROUND CIRCUIT BREAKER

FIELD OF THE INVENTION

The present invention is directed to a ground path for a musical instrument, and more particularly to a ground path having a circuit breaker for an electric musical instrument.

BACKGROUND OF THE INVENTION

Professional and amateur musicians often employ stringed instruments that are fitted with pickups, i.e., devices that allow the instruments to be electrically connected to an amplifier. However, the use of electric amplifiers and other peripheral equipment, such as microphones, creates a risk of electrical shock, which in some cases may be lethal.

The threat of electrical shock may arise through various types of electrical malfunction such as: 1) an electrical failure in the musician's equipment; 2) improper wiring of the power circuit to which the musician's equipment is attached; and/or 3) an electrical failure of peripheral equipment. One example of the first type of malfunction occurs when a guitarist's amplifier induces a high voltage to the ground side of the guitar output jack. An example of the second type of malfunction is improper wiring of a three-pronged electrical wall socket such as where the "earth" ground is not connected and the "neutral" and "hot" sides of the outlet are reversed, thereby resulting in a high voltage being applied to the "neutral" lead. An example of the third type of malfunction occurs when the musician's equipment is functioning properly while connected to properly wired wall sockets, but other equipment, such as a microphone, is improperly grounded.

Often in electric instruments, an earth ground is provided, such as through an amplifier. The earth ground reduces the amount of audible noise by providing a pathway for any induced noise to drain from the instruments circuitry. However, in some cases the earth ground is not present or is insufficient. A common way to provide noise reduction in instruments where the earth ground is lacking has been to provide the "grounded effect" by including a "string" ground.

String grounds are commonly used in electric guitar circuitry. A string ground generally includes a conductive path between the strings to the ground output or ground plane of the guitar circuitry. In the most common string ground configuration, the metal guitar strings touch a metal bridge and a wire that is connected between the metal bridge and the outside casing of a volume potentiometer or shielding inside the guitar. Although such a design provides a reduction in noise it also creates the mechanism, which in conjunction with any one of the previously mentioned malfunctions, may result in the musician being electrically shocked.

Suggestions for minimizing the risk of electrical shock have included checking the power outlets to which all of the musician's equipment, as well as any peripheral equipment, is connected with an outlet tester. However, such a practice may not always be feasible. Testing every outlet may be extremely time consuming and it may not be allowed where the sockets are used to power equipment not controlled by the musician.

The use of Ground Fault Circuit Interruptor (GFCI) extension cords has also been suggested as a practice that can reduce the risk of electrical shock. The practice includes plugging electrical equipment into a GFCI extension cord and plugging the extension cord into a wall socket. Such a circuit will trip, or open, if a certain threshold leakage current is detected. However, such a practice has various disadvantages. First, any GFCI extension cord must be tested prior to each use to assure that it is functioning properly. Next, a large number of the devices may be required for productions utilizing many pieces of equipment, which may result in the technique being prohibitively expensive. Additionally, to thoroughly utilize the technique a GFCI device must be used with any equipment that the musician will contact, including peripheral equipment not owned by the musician.

Various alterations to electrical musical instrument, such as guitars, have also been suggested to reduce the risk of electrical shock. For example, removing the string ground has been recommended. However, such an alteration also removes the noise reduction benefits provided by the ground.

Another suggested alteration requires placing a capacitor and a resistor in parallel within the string ground path. However, the alteration does not prevent a shock from occurring, but it may, if the capacitance and resistance are sufficient, prevent the shock from being lethal. In fact, the alteration does not provide a strict maximum current limit, but rather reduces the current level. As a result, even after the current has been reduced by such a device, the reduced current may still be lethal.

In view of the above, there exists a need for a musical instrument featuring a string ground path that is configured to reduce the risk of electrical shock.

SUMMARY OF THE INVENTION

In view of the foregoing, it is an object of the present invention to provide a musical instrument featuring a string ground circuit having a circuit breaker.

It is another object of the invention to provide a musical instrument featuring a string ground circuit that includes a replaceable fuse that is rated to open the string ground circuit upon application of a non-lethal current.

It is another object of the invention to provide a string ground circuit including a circuit breaker that may be incorporated into a guitar as a retrofit or during initial construction.

One aspect of the invention involves a musical instrument string ground circuit that includes a circuit breaker. The circuit breaker is configured to open the string ground circuit upon application of a current having a magnitude that is greater than a predetermined current limit.

In the preferred embodiment of the invention, a musical instrument includes electrically conductive strings and a string ground circuit that extends between the strings and a ground connector. The string ground circuit includes a circuit breaker that prohibits the flow of current through the string ground circuit that has a magnitude above a predetermined current limit. The circuit breaker is a fuse that includes a fuse socket and a removable fuse.

These and other features and advantages of the present invention will be appreciated from review of the following detailed description of the invention, along with the accompanying figures in which like reference numerals refer to like parts throughout.

DETAILED DESCRIPTION

In the following paragraphs, the present invention will be described in detail by way of example with reference to the attached drawings. Throughout this description, the preferred embodiment and examples shown should be considered as exemplars, rather than as limitations on the present invention. As used herein, the "present invention" refers to any one of the embodiments of the invention described herein, and any equivalents. Furthermore, reference to various feature(s) of the "present invention" throughout this document does not mean that all claimed embodiments or methods must include the referenced feature(s).

When a musician encounters an electrically charged instrument, or piece of peripheral equipment, through one of the previously mentioned electrical malfunctions, the musician's body may become part of the path of least electrical resistance for high current. If so, high magnitude current may pass through the string ground circuit and the musician. The present invention provides a musical instrument featuring a string ground circuit having a circuit breaker that provides a musician protection from electrical shock.

Figure 1:
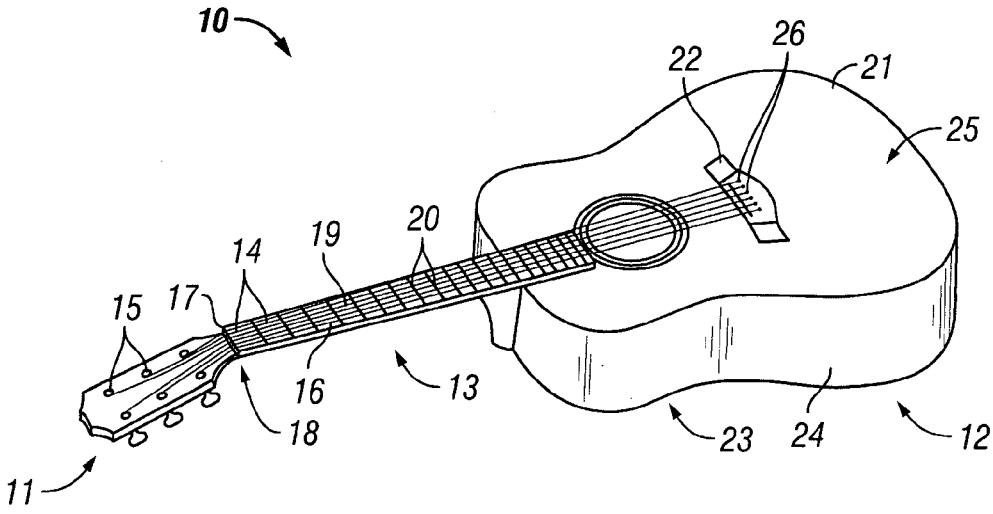
FIG. 1 is perspective view of a musical instrument including a string ground circuit having a circuit breaker, in accordance with the principles of the present invention.

A musical instrument 10, which may be a guitar as illustrated in FIG. 1, generally includes a head 11, a body portion 12, a neck portion 13 that extends between head 11 and body portion 12, and a plurality of strings 14. A plurality of tuning heads 15 are mounted on head 11 and a first end of each string 14 is wrapped around a portion of a respective tuning head 15 so that when the opposite ends of strings 14 are fixedly coupled to body portion 12. Actuation of tuning heads 15, for example by rotation, may be used to adjust the tension in strings 14.

Figure 2:
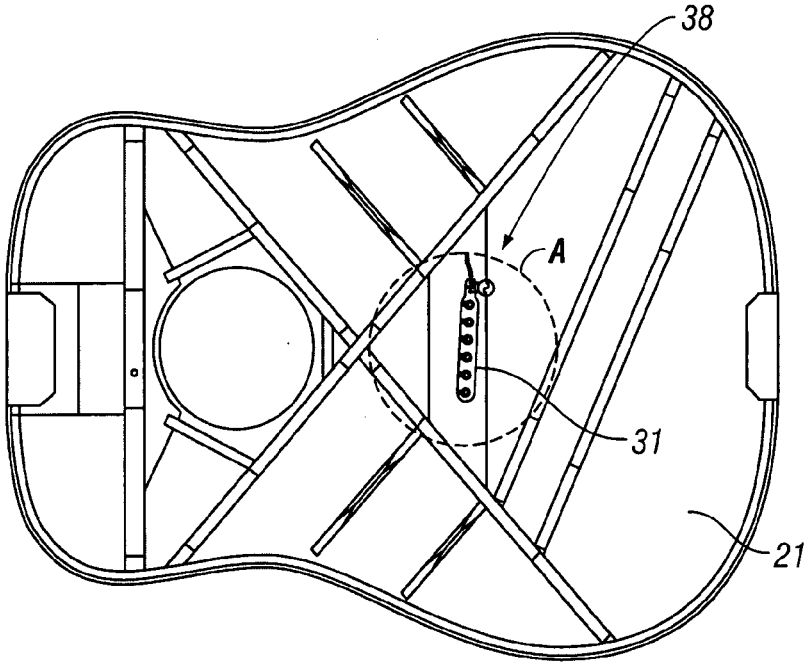
FIG. 2 is a bottom view of a top plate of a body portion of the musical instrument of FIG. 1 showing a string ground circuit with a circuit breaker, in accordance with the principles of the present invention.

Body portion 12 may be hollow, as shown, or solid. Body portion 12 generally includes atop plate 21, or soundboard, a bridge plate 22, a bottom plate 23 and side walls 24. In the illustrated embodiment, side walls 24 are coupled to each of top plate 21 and bottom plate 23 along the periphery of each and extend between top plate 21 and bottom plate 23 to form a cavity. Bridge plate 22 is coupled to a top surface of top plate 21 and provides string mounting features so that an end of each string 14 may be fixedly coupled to body portion 12. It shall be appreciated that body portion 12 may also include any number of braces, linings, channels and/or tail blocks located anywhere on or within body portion 12 as shown in FIG. 2 and as would be recognized in the art.

As mentioned above, neck portion 13 extends between head 11 and body portion 12. Neck portion 13 generally includes an elongated neck member 16, a nut 17, a fretboard 19 and a plurality of frets 20. A first end of neck member 16 is fixed to head 11, while a second end of neck member 16 is fixed to body portion 12. Neck member 16 may be fixed to head 11 and body portion 12 by any method known in the art, such as mechanical fasteners (e.g., screws, bolts) and/or adhesives. Neck member 16 may be constructed from wood, plastic, metal or a combination thereof as would be appreciated by a person having ordinary skill in the art.

Nut 17 is coupled to neck member 16 at the first end of neck portion 13 adjacent to head 11. Nut 17 may be a block having any cross-sectional shape constructed from plastic, metal, ivory, wood or any other material known in the art. Nut 17 may also include grooves (not shown) for receiving and orienting strings 14. Nut 17 may be fixedly coupled to neck member 16, such as by mechanical fasteners and/or adhesives, or nut 17 may be held in place against neck member 16 by strings 14.

Fretboard 19 may be coupled to a top surface of neck member 16. Fretboard 19 is generally a thin elongated member. Fretboard 19 may extend from nut 17 toward body portion 12. Fretboard 19 overlays neck member 16 and a portion of top plate 21 of body portion 12. Fretboard 19 may be constructed from wood, plastic, metal or any combination thereof and fretboard 19 may further include decorative features, such as inlays. Fretboard 19 may be fixed to neck member 16 by mechanical fasteners and/or adhesives or by any other attachment technique known in the art.

Frets 20 are fixedly coupled to fretboard 19. Frets 20 generally extend laterally across fretboard 19 and above the top surface of fretboard 19. Frets 20 may be made of metal, plastic, wood or any other material known in the art and they may be fixed to fretboard 19 by inserting a portion of each fret 20 into a slit, or channel, machined in fretboard 19. Furthermore, frets 20 may also, or alternatively, be coupled to fretboard using mechanical fasteners and/or adhesives.

A first end of each string 14 is wrapped around a portion of a respective tuning head 15. Each string 14 is drawn over nut 17, along and spaced above fretboard 19 and frets 20, over a saddle 32 and fixedly coupled to body portion 12, as described below. As is well known in the art, actuation of tuning heads 15, for example by rotation, may be used to adjust the tension in strings 14. Strings 14 are conductive and may be constructed from steel, brass or any other material known in the art.

Figure 4:
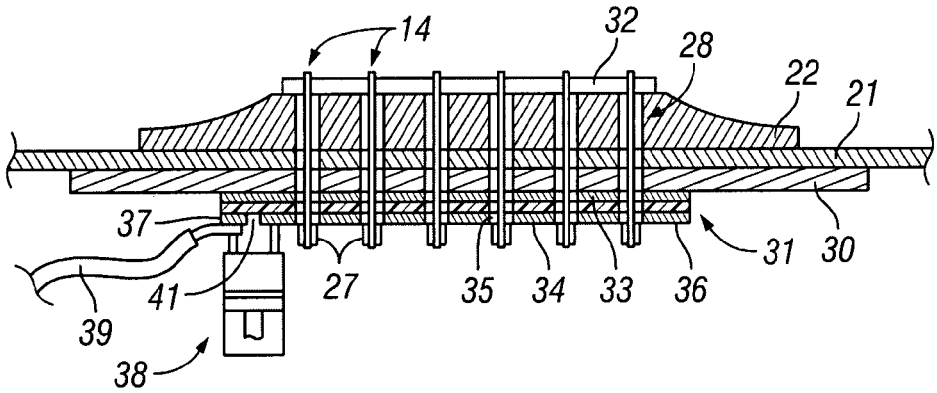
FIG. 4 is a cross-sectional view of a portion of the musical instrument of FIG. 1 taken along line B-B of FIG. 3.
Figure 5:
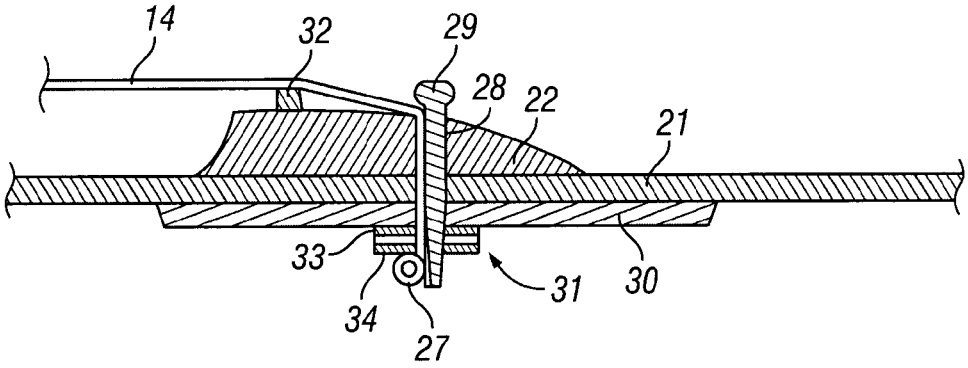
FIG. 5 is a cross-sectional view of a portion of the musical instrument of FIG. 1 taken along line C-C of FIG. 3.

As shown in FIGS. 4 and 5, a ball end 27 on an end of each string 14 is inserted through a bridge aperture 28 and held in place by a bridge pin 29. Bridge aperture 28 extend from the environment through bridge plate 22, top plate 21, a pin plate 30 and a ground plate 31 and into the cavity defined by body portion 12.

Ground plate 31 is affixed to a bottom surface of pin plate 30 so that each of a plurality of ground plate apertures 35 define a lower portion of bridge apertures 28. Ground plate 31 and pin plate 30 may be coupled by an adhesive or any type of fastener known in the art. Ground plate 31 includes a bottom conductive layer 34, a top conductive layer 33 and ground plate apertures 35. Preferably conductive layers 33 and 34 are separated by a nonconductive layer 40. Ground plate 31 may be constructed from materials such as paper-phenolic, or glass-epoxy materials or plastics such as polyamide or polystyrene. Each of the conductive layers may be created as a surface coating or a laminate layer and the conductive material of layers 33 and 34 may be copper, tin, brass, silver, nickel or any other conductive material known in the art. According to further embodiments of the invention, ground plate 31 may be replaced by one or more jumper wires (not shown).

Figure 3:
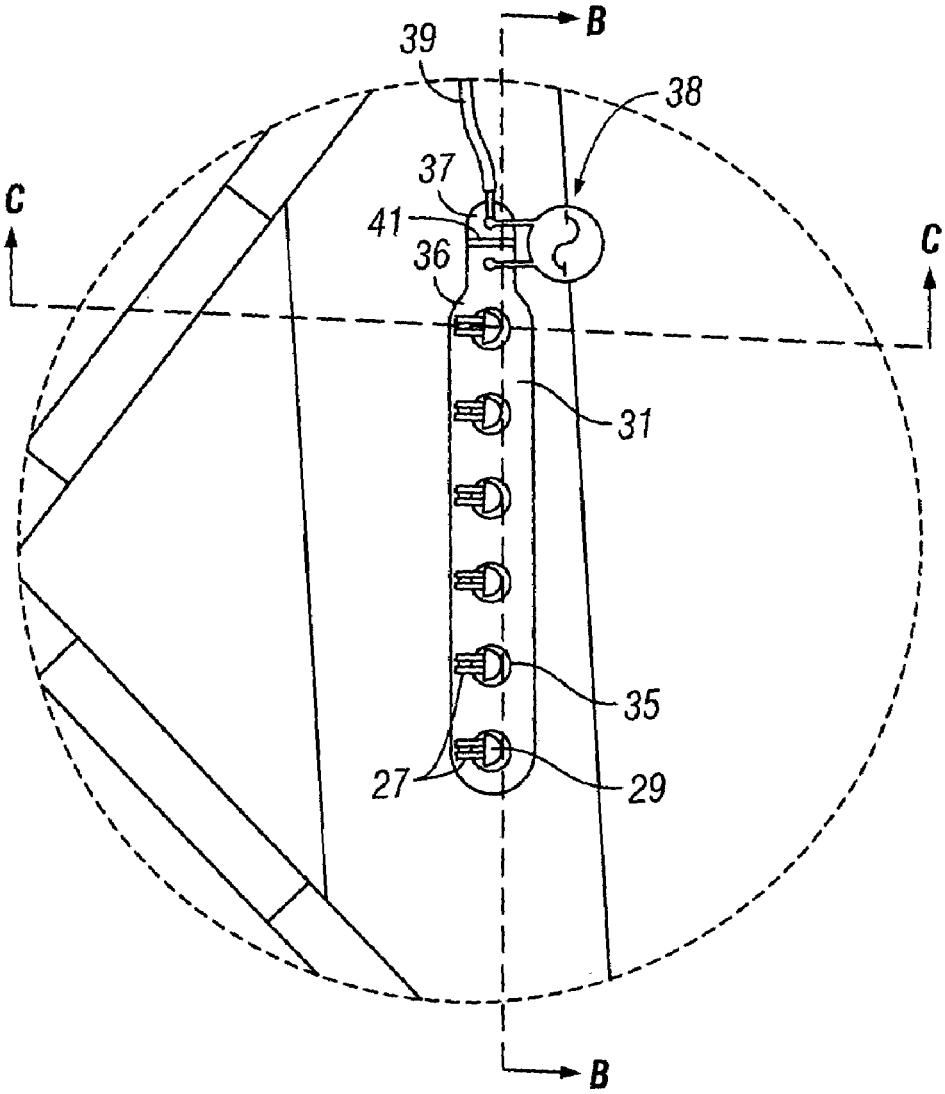
FIG. 3 is an enlarged detail view of a portion A, shown in FIG. 2, of the musical instrument of FIG. 1 showing a string ground with a circuit breaker, in accordance with the principles of the present invention.

As shown in FIGS. 3 and 4, bottom surface coating 34 of ground plate 31 is preferably discontinuous, such that there is a gap 41, and thereby ensuring that there is no direct electrical conduction between a first portion 36 and a second portion 37 of conductive layer 34. According to an aspect of the invention, a circuit breaker 38 is connected in series between first portion 36 and second portion 37. As used herein, "circuit breaker" is any device, active or passive, that is capable of creating an open circuit when it is subjected to a predetermined threshold electrical current value. In the illustrated embodiment, circuit breaker 38 comprises a passive device such as a fuse. Upon application of a current greater than a predetermined limit, the circuit breaker transforms from a closed circuit configuration to an open circuit configuration that prevents current flow therethrough.

Circuit breaker 38 may comprise a micro-type fuse plugged into a fuse socket that is electrically coupled in series between first portion 36 and second portion 37 of conductive layer 34. For example, circuit breaker 38 may be a replaceable micro-type fuse, such as a Micro Very Fast-Acting Subminiature Plug-In Fuse manufactured by Littlefuse, Inc. of Des Plaines, Ill. Circuit breaker 38 may be coupled to first and second portions 36 and 37 of conductive layer 34 by soldering, welding or any other electrically conductive fixation technique known in the art.

In accordance with the principles of the invention, circuit breaker 38 is selected so that it creates an open circuit before a lethal current is able to pass through the string ground circuit and the musician. As shall be appreciated, the threshold current rating, or current limit, of circuit breaker 38 is selected so that circuit breaker 38 will trip (i.e., create an open circuit) prior to a lethal current passing through the string ground circuit. For circuit breaker 38, it is desirable that the threshold current value is in the range of 1-30 milliamps (mA). Preferably, the threshold value is in the range of approximately 1-7 mA, and most preferably about 5 mA.

Figure 9:
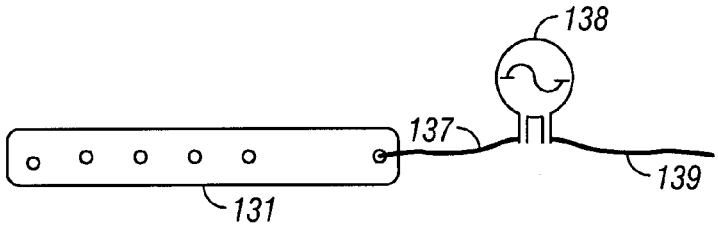
FIG. 9 is a perspective view of an alternative embodiment of the present invention.

It shall further be appreciated that although circuit breaker 38 is shown directly coupled to ground plate, the circuit breaker may be placed anywhere within the string ground circuit. One such embodiment is shown in FIG. 9. In this embodiment, ground plate 131 is shown. Ground wire 137 is soldered or otherwise electrically connected to ground plate 131. Ground wire 137 is also electrically connected in series to circuit breaker 138 which in turn is electrically connected to ground wire 139.

With further reference to FIG. 4, ground wire 39 is preferably electrically coupled to second portion 37 of conductive layer 34, or directly to circuit breaker 38, to provide a conductive path from circuit breaker 38 to a ground connector (not shown), such as a jack plate. The ground connector may be any structure that is used to electrically couple the electronics of the instrument to an earth ground provided through an amplifier. For example, the instrument's circuitry may include a ground circuit that is electrically coupled (sometimes through the housing of a volume potentiometer) to an external jack plate mounted directly on the instrument body.

The jack plate is preferably coupled to a ground wire in a chord extending to the amplifier, whereas the ground connector is preferably mounted directly to the body portion of the instrument. According to additional embodiments of the invention, the ground connector may be indirectly mounted to the body portion. For example, the ground connector may comprise an audio jack attached to the end of a wire pigtail that extends from any portion of the instrument. Ground wire 39 may be any conductive wire that is directly connected to one or both of second portion 37 and circuit breaker 38 using any electrically conductive fixation technique known in the art, such as soldering.

Each string 14 and/or ball end 27 is installed so that it is placed in contact with conductive layer 34 of ground plate 31, as shown in FIG. 5. During installation of a string 14, ball end 27 is inserted through bridge aperture 28 and into the cavity defined by body portion 12. String 14 is then gently pulled while bridge pin 29 is pressed into bridge aperture 28. A properly installed bridge pin 29 wedges the respective string 14 against the sidewall of aperture 28 while ball end 27 is held in contact with a first portion 36 of conductive layer 34 of ground plate 31. The interaction between ball end 27 and conductive layer 34 provides conduction between string 14 and ground plate 31. As described above, the interfaces between remaining components in the string ground circuit are created using known electrically conductive fixation techniques, such as soldering.

It shall be appreciated that the string ground circuit path extends between strings 14 and the ground connector, through at least strings 14, circuit breaker 38 and the ground connector. As previously mentioned and shown, the string ground circuit path may also include additional conductive members such as ball ends, a ground plate and/or the housing of a volume potentiometer.

Figure 6:
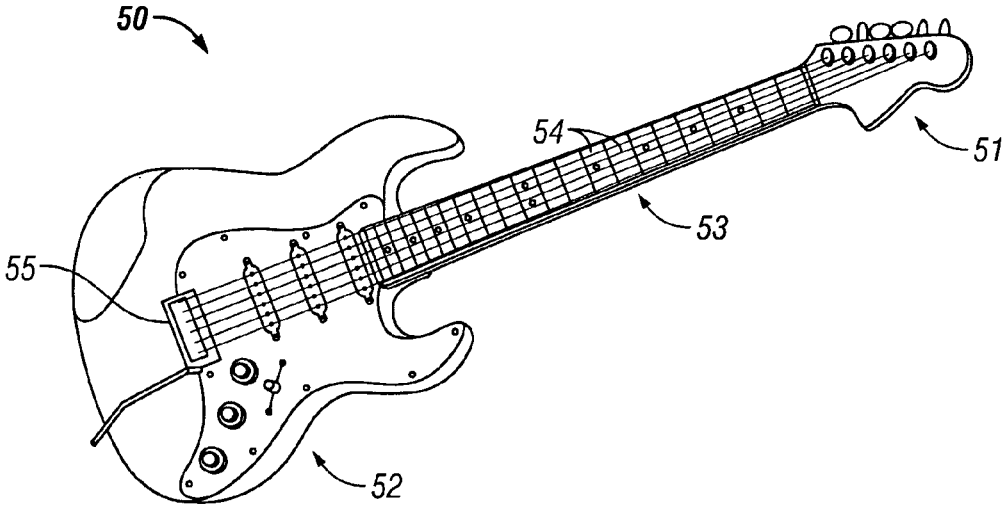
FIG. 6 is perspective view of a musical instrument including a string ground circuit having a circuit breaker, according to another embodiment of the present invention.
Figure 7:
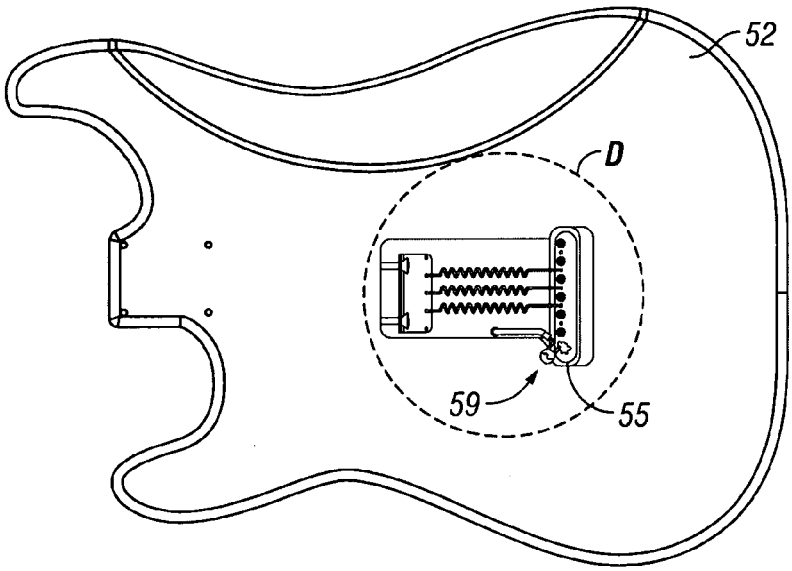
FIG. 7 is a cut-away view of the back side of the front of the body portion of the musical instrument of FIG. 6.
Figure 8:
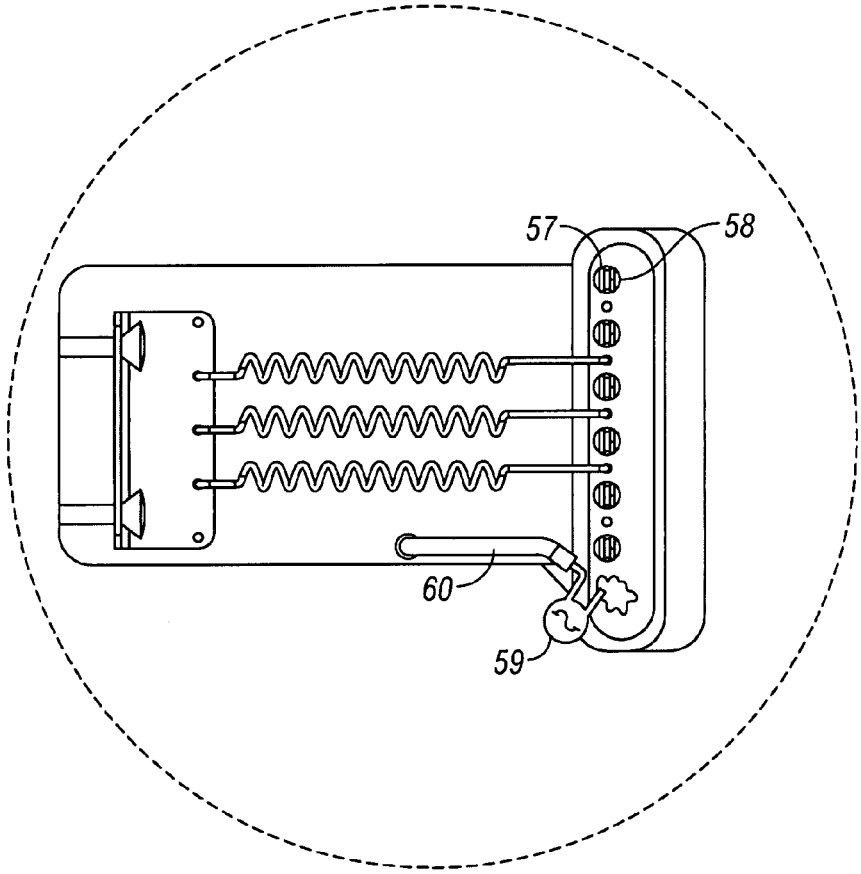
FIG. 8 is an enlarged detail view of a portion D, shown in FIG. 7, of the musical instrument of FIG. 6 showing a string ground circuit with a circuit breaker, in accordance with the principles of the present invention.

Referring to FIGS. 6-8, a musical instrument 50 is constructed with a head 51, a body portion 52, a neck portion 53 and a plurality of strings 54. With the exception of body portion 52 and the configuration of strings 54, the structural components of musical instrument 50 are generally functionally identical to the corresponding parts described above with respect to the instrument 10 of FIGS. 1-5, and therefore will not be described in further detail.

Body portion 52 of musical instrument 50 is solid and may include cavities that house circuitry for the pickups as well as volume and tone controls. Strings 54 may be coupled to body portion 52 through a tremolo 55, rather than a stationary bridge. Tremolo 55 is constructed from metal and functions as a ground plate such that a separate ground plate is not needed.

As depicted in FIG. 6, strings 54 are suspended between tremolo 55 and a nut on neck portion 53. Referring to FIG. 8, the ball ends 57 of the strings 54 prevents the strings 54 from slipping through tremolo apertures 58. Strings 54 and ball ends 57 are electrically conductive and the contact between ball ends 57 and tremolo 55 provide electrical conduction between strings 54 and tremolo.

According to an aspect of the invention, circuit breaker 59 is electrically coupled to, and interposed between, tremolo 55 and a ground wire 60 that extends to a ground connector (not shown) to create a string ground. Similar to the previously described embodiments, ground connector may be a jack plate that is mounted directly on body portion 52 or it may be electrically coupled to a wire extending from instrument 50.

According to a preferred implementation of the invention, the musical instrument comprises an acoustic guitar that includes pickups for transforming the motion of strings 14 into electric signals. However, as would be appreciated by those of ordinary skill in the art, the principles described herein may be applied to any additional musical instruments utilizing conductive strings and pickups, such as including electric guitars, mandolins, basses, violins and cellos, without departing from the scope of the present invention.

It shall be appreciated that an existing string ground circuit in an instrument may be modified, or retrofitted, to include a circuit breaker in accordance with the present invention. Furthermore, a string ground circuit with a circuit breaker may be added to an existing instrument or built into an instrument during initial manufacturing.

Furthermore, the string ground circuit of the present invention may be configured so that the circuit breaker may be easily replaced without requiring the assistance of a technician. Additionally, the circuit breaker of the present invention may be placed anywhere in the string ground circuit and anywhere that allows easy access for replacement. Furthermore, the circuit breaker of the present invention may be resettable so that rather than requiring replacement it may be reset to return the circuit breaker to a closed circuit configuration.

It shall further be appreciated that the string ground circuit of the present invention may be used in any instrument that employs conductive strings, regardless of the number of strings, and it may be used in conjunction with any type or combination of pickups, such as electromagnetic and/or piezoelectric pickups. In addition, it shall be appreciated that the string ground circuit may also provide a visual or audible indication of the activation of the circuit breaker. In other words, the musician may be alerted when the circuit breaker is tripped, or transformed from the closed configuration to the open configuration.

One skilled in the art will appreciate that the present invention can be practiced by other than the various embodiments and preferred embodiments, which are presented in this description for purposes of illustration and not of limitation, and the present invention is limited only by the claims that follow. It is noted that equivalents for the particular embodiments discussed in this description may practice the invention as well.

What is claimed is:

1. A musical instrument, comprising:

an instrument body;

at least one electrically conductive string coupled to the body;

a ground connector mounted to the instrument body;

a string ground circuit electrically coupling the strings to the ground connector; and wherein the string ground circuit includes a circuit breaker having a current path that defines a portion of the string ground circuit between the strings and the ground connector.

2. The musical instrument of claim 1, wherein the circuit breaker has an open circuit configuration and a closed circuit configuration.

3. The musical instrument of claim 2, wherein the circuit breaker is configured such that it is in the open configuration after current having a predetermined magnitude is applied to the current path.

4. The musical instrument of claim 1, wherein the circuit breaker is a fuse.

5. The musical instrument of claim 4, wherein the fuse includes a fuse socket and a removable fuse.

6. The musical instrument of claim 1, wherein the string ground circuit further comprises a ground wire connected in series with the circuit breaker that extends through a portion of the instrument body.

7. The musical instrument of claim 1, wherein the at least one string is electrically coupled to a conductive ground plate.

8. The musical instrument of claim 7, wherein the conductive ground plate is a tremolo.

9. The musical instrument of claim 1, wherein the ground connector is a jack plate mounted directly to the instrument body.

10. The musical instrument of claim 1, wherein the ground connector is mounted indirectly to the instrument body through a wire pigtail.

11. The musical instrument of claim 8, wherein the predetermined current magnitude is between 1 and 30 mA.

12. The musical instrument of claim 8, wherein the predetermined current magnitude is between 4 and 6 mA.

13. A string ground circuit for a musical instrument including a body and at least one electrically conductive string, the string ground circuit comprising:

a conductive ground plate configured to be electrically coupled to the at least one string;

a ground connector configured to be mounted to the instrument body; and a circuit breaker electrically coupled in series between the ground plate and the ground connector.

14. The string ground circuit of claim 13, wherein the circuit breaker is configured such that current flow through the circuit breaker above a predetermined current limit is prohibited.

15. The musical instrument of claim 13, wherein the circuit breaker is a fuse.

16. The musical instrument of claim 15, wherein the fuse includes a fuse socket and a removable fuse.

17. The musical instrument of claim 13, wherein the current limit is between 1 and 30 mA.

18. The musical instrument of claim 13, wherein the current limit is between 4 and 6 mA.

19. A musical instrument, comprising:

a instrument body;

a plurality of electrically conductive strings coupled to the body;

a ground connector mounted directly to the instrument body; and a circuit breaker electrically coupled in series between at least one string and the ground connector.

20. The musical instrument of claim 19, wherein the circuit breaker is configured such that current flow through the circuit breaker above a predetermined current limit is prohibited.

21. The musical instrument of claim 19, wherein the circuit breaker is a fuse.

22. The musical instrument of claim 19, wherein the current limit is between 1 and 30 mA.

23. The musical instrument of claim 19, wherein the current limit is between 4 and 6 mA.

24. The musical instrument of claim 19, wherein the ground connector is a jack plate.

* * * * *